US007341423B2

(12) United States Patent
Kabasawa et al.

(10) Patent No.: US 7,341,423 B2
(45) Date of Patent: Mar. 11, 2008

(54) MOLECULAR PUMP AND CONNECTING DEVICE

(75) Inventors: Takashi Kabasawa, Narashino (JP); Yoshiyuki Sakaguchi, Narashino (JP)

(73) Assignee: Edwards Japan Limited (JP)

( * ) Notice: Subject to any disclaimer, the term of this patent is extended or adjusted under 35 U.S.C. 154(b) by 188 days.

(21) Appl. No.: 10/925,050

(22) Filed: Aug. 24, 2004

(65) Prior Publication Data

US 2005/0047905 A1 Mar. 3, 2005

(30) Foreign Application Priority Data

Aug. 27, 2003 (JP) ..... 2003-303526

(51) Int. Cl.
*F04D 19/04* (2006.01)

(52) U.S. Cl. ..... 415/90; 415/9; 415/214.1

(58) Field of Classification Search ..... 415/9, 415/90, 143, 213.1, 214.1; 417/423.4
See application file for complete search history.

(56) References Cited

U.S. PATENT DOCUMENTS 3,625,019 A * 12/1971 Osterstrom ..... 415/90
6,485,254 B1 * 11/2002 Davis ..... 415/9
6,679,677 B2 * 1/2004 Yamauchi ..... 415/90
6,752,588 B2 * 6/2004 Kawanishi et al. ..... 415/90
6,824,349 B2 * 11/2004 Okudera et al. ..... 415/9
6,899,529 B2 * 5/2005 Ishikawa et al. ..... 417/423.4
7,059,823 B2 * 6/2006 Sakaguchi et al. ..... 415/9
2002/0172589 A1 * 11/2002 Yamashita et al. ..... 415/90
2003/0053918 A1 * 3/2003 Yamaguchi et al. ..... 417/423.4

FOREIGN PATENT DOCUMENTS

JP 8-114196 A * 5/1996
JP 10-274189 A * 10/1998

* cited by examiner

*Primary Examiner*—Christopher Verdier
(74) *Attorney, Agent, or Firm*—Adams & Wilks

(57) ABSTRACT

A flange of a molecular pump is connected to a vacuum vessel by first bolts that extend through elongate holes in the flange and are bolted to the vacuum vessel. One or more buffering members are attached to the flange by the first bolts that extend through first openings in the buffering members and by second bolts that extend through second openings in the buffering members and are bolted to the flange. In the event of malfunction of the molecular pump that generates an abnormally high torque, the buffering members plastically deform and absorb the shock energy caused by the abnormal torque thereby preventing damage to the vacuum vessel.

20 Claims, 9 Drawing Sheets

(a)

(b)

(a)

(b)

(a)

(b)

MOLECULAR PUMP AND CONNECTING DEVICE

BACKGROUND OF THE INVENTION

1. Field of the Invention

The present invention relates to a molecular pump and a connecting device for connecting a vessel incorporating a rotator rotating at a high speed to another vessel.

2. Description of the Related Art

For evacuation of a vacuum vessel requiring high vacuum used in, for example, semiconductor manufacturing equipment or electron microscope equipment, a molecular pump having high evacuating performance has been used. As such a molecular pump, for example, a turbo-molecular pump, a thread groove pump, and the like are available.

Evacuation of the vacuum vessel is accomplished in a state in which an inlet of molecular pump is attached to an outlet of vacuum vessel with bolts, etc.

In the molecular pump, a rotor section is pivotally supported so as to be rotated at a high speed by the action of a motor. Also, in the molecular pump, a stator section is provided in such a manner as to be fixed to a housing.

The molecular pump is configured so that the rotor section and the stator section perform evacuating operation by high-speed rotation of the rotor section. By this evacuating operation, gas is sucked through the inlet of molecular pump and is exhausted through an outlet thereof.

Usually, the molecular pump that accomplishes evacuation in a molecular flow region carries out evacuation by rotating the rotor section at a high speed (for example, 30,000 rpm).

If extreme disturbance or a trouble such as deformation of rotor section or stator section occurs during the operation of molecular pump in which the rotor section rotates at a high speed in this manner, and thus the rotor section comes into contact with a fixed member such as the stator section, angular momentum (moment of momentum) of rotor section is transmitted to the housing.

Thereby, there is produced torque that rotates the whole of molecular pump in the rotation direction of the rotor section. This torque also gives a great stress to the vacuum vessel to which the molecular pump is attached.

Conventionally, a technique for easing shock caused by torque generated at such emergency time has been proposed in Patent Documents listed below.

[Patent Document 1] Unexamined Japanese Patent Publication No. 8-114196

[Patent Document 2] Unexamined Japanese Patent Publication No. 10-274189

Patent Document 1 has proposed a technique in which torque generated in a turbo-molecular pump by breakage of rotor section or by other causes is absorbed by plastically deforming bolts that join the turbo-molecular pump to a vacuum vessel into a chevron shape.

In order to deform the bolts in this manner, bolt holes in a flange on the turbo-molecular pump side are formed in an elongated shape in the rotation direction of the rotor, and a claw-shaped thin sheet portion is formed near the bottom of elongated hole to deform the bolts into a chevron shape.

Patent Document 2 has proposed a technique in which shock of torque generated in the turbo-molecular pump is eased by sliding the flange in the rotation direction of the rotor.

Specifically, an elongated hole shaped bolt hole is formed along the arc of flange, and the turbo-molecular pump is installed to the vacuum vessel via this bolt hole. By sliding the elongated hole shaped bolt hole, the turbo-molecular pump is rotated relative to the vacuum vessel, and thereby shock energy is consumed as its rotational energy.

SUMMARY OF THE INVENTION

In the turbo-molecular pump proposed in Patent Document 1, shock is absorbed by deforming the bolts. However, in such a configuration, it is difficult to ensure a sufficient stroke necessary for absorbing shock energy.

Also, in the turbo-molecular pump proposed in Patent Document 2, there is a fear of being incapable of sufficiently absorbing shock energy only by the rotational energy caused by the sliding of the elongated hole shaped bolt hole.

Accordingly, an object of the present invention is to provide a molecular pump and a connecting device capable of effectively absorbing shock energy due to abnormal torque generated at an emergency time during malfunction of the molecular pump by using a simple construction.

In an invention of a first aspect, to achieve the above object, there is provided a molecular pump which is attached to a vacuum vessel to exhaust gas in the vacuum vessel, including a casing provided with an inlet and an outlet; a rotor which is pivotally supported in the casing and is provided with a gas transfer mechanism for transferring gas from the inlet to the outlet; a motor for rotating the rotor; a flange-shaped attachment portion which is formed in an end portion of the casing or in a portion opposite thereto and is formed with a fastening hole penetrating in the thickness direction and an elongated hole extending from the fastening hole in the direction opposite to the rotation direction of the rotor; a buffering member having a buffering portion, a first fixing portion which is provided at one end of the buffering portion and has a fastening hole, and a second fixing portion formed at the other end of the buffering portion; fastening means for fastening the buffering member to the casing via the fastening hole in the attachment portion and the fastening hole in the buffering member; and fixing means for fixing the second fixing portion of the buffering member to the attachment portion.

In an invention of a second aspect, to achieve the above object, in the invention of the first aspect, the buffering member is formed by a plurality of members having a different stress-strain characteristic.

The buffering member described in the invention of the second aspect may be configured by combining members, for example, having different strain before the stress reaches the maximum value.

In an invention of a third aspect, to achieve the above object, in the invention of the first or second aspect, the fastening means has a higher strength than the fixing means.

In an invention of a fourth aspect, to achieve the above object, in the invention of the first, second, or third aspect, the fixing means is arranged on the side opposite to the side on which the elongated hole is formed with respect to the fastening means.

The fixing means described in the invention of the fourth aspect may be arranged on the side opposite to the rotation direction of the rotor with respect to the fastening means.

In an invention of a fifth aspect, to achieve the above object, in the invention of the first, second, third, or fourth aspect, at least one of the fastening means and the fixing means is formed by a bolt having a head at the terminal end thereof, and the fixing portion of the buffering member which is in contact with the head of the bolt is in contact with the head of the bolt over the whole circumference thereof.

In an invention of a sixth aspect, to achieve the above object, there is provided a connecting device for connecting a first vessel and a second vessel, at least one of which incorporates a rotator, to each other, including a flange formed with a fastening hole which is formed in a connecting portion between one vessel of the first vessel and the second vessel and the other vessel thereof and has a fastening hole penetrating in the thickness direction and an elongated hole extending from the fastening hole in the direction such that the one vessel moves relatively when being subjected to a shock due to torque in the rotation direction of the rotator; a buffering member having a buffering portion, a first fixing portion which is provided at one end of the buffering portion and has a fastening hole, and a second fixing portion formed at the other end of the buffering portion; fastening means for fastening the first vessel to the second vessel via the fastening hole in the flange and the fastening hole in the buffering member; and fixing means for fixing the second fixing portion of the buffering member to the flange.

The buffering member described in the invention of the sixth aspect may be formed by a plurality of members, for example, having a different stress-strain characteristic. The fastening means may be configured so as to, for example, have a higher strength than the fixing means. Further, the fixing means may be arranged, for example, on the side opposite to the side on which the elongated hole is formed with respect to the fastening means. Also, the configuration may be such that, for example, at least one of the fastening means and the fixing means is formed by a bolt having a head at the terminal end thereof, and the fixing portion of the buffering member which is in contact with the head of the bolt is in contact with the head of the bolt over the whole circumference thereof.

According to the present invention, by deforming the buffering member provided in the connecting portion between the first vessel and the second vessel, there can be provided a molecular pump and a connecting device capable of effectively consuming shock energy due to torque generated when the rotator operates abnormally.

DESCRIPTION OF THE PREFERRED EMBODIMENTS

Preferred embodiments of a connecting device in accordance with the present invention will now be described in detail with reference to FIGS. 1 to 11.

1. First Embodiment

Figure 1:
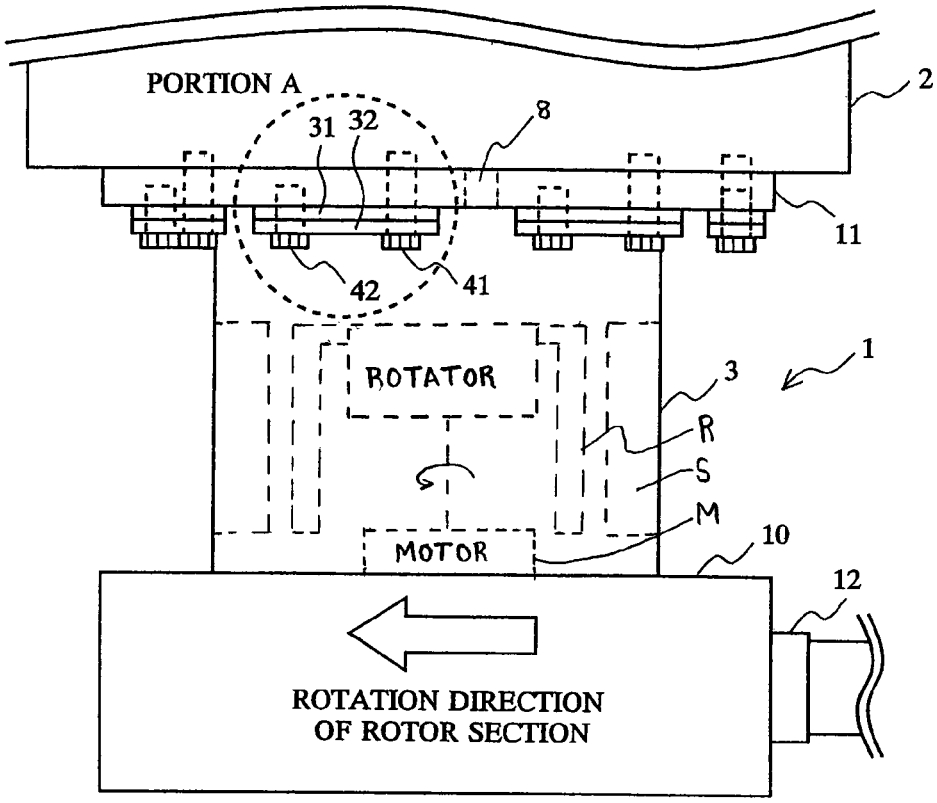
FIGS. 1(*a*)-1(*b*) are views showing one example of a connection mode of a molecular pump to a vacuum vessel in accordance with a first embodiment.
Figure 1:
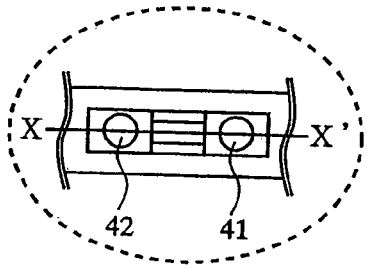

FIG. 1 is a view showing one example of a connection mode of a molecular pump to a vacuum vessel in accordance with a first embodiment.

A molecular pump 1 is a vacuum pump that performs an evacuating function by the evacuating operation of a rotor section R rotating at a high speed and a fixed stator section S. As the molecular pump 1, a turbo-molecular pump, a thread groove pump, or a composite pump having a construction of both of the pumps can be used.

The molecular pump 1 has a cylindrical casing 3 that forms a housing together with a base 10, and the casing 3 is provided with an inlet 8 and an outlet 12.

The casing 3 contains a structure for causing the molecular pump 1 to perform the evacuating function.

The structure for performing the evacuating function is broadly made up of the rotatably supported rotor section R and the stator section S fixed to the casing 3. The rotor section is rotated at a high speed by the action of a motor M.

That is, the casing 3 forms a vessel incorporating a rotator.

Also, the base 10 forms a vessel incorporating a part of a gas transfer mechanism.

At the end of the inlet of the casing 3, a flange 11 is formed so as to protrude to the outer periphery side from the casing 3. The flange 11 is used as a connecting device for connecting the molecular pump 1 to a vacuum vessel 2.

The vacuum vessel 2 forms a vacuum device such as semiconductor manufacturing equipment or a lens barrel for electron microscope, and is provided with an outlet.

The molecular pump 1 is connected to the outlet of the vacuum vessel 2 via the flange 11 by using fastening means such as bolts.

Figure 2:
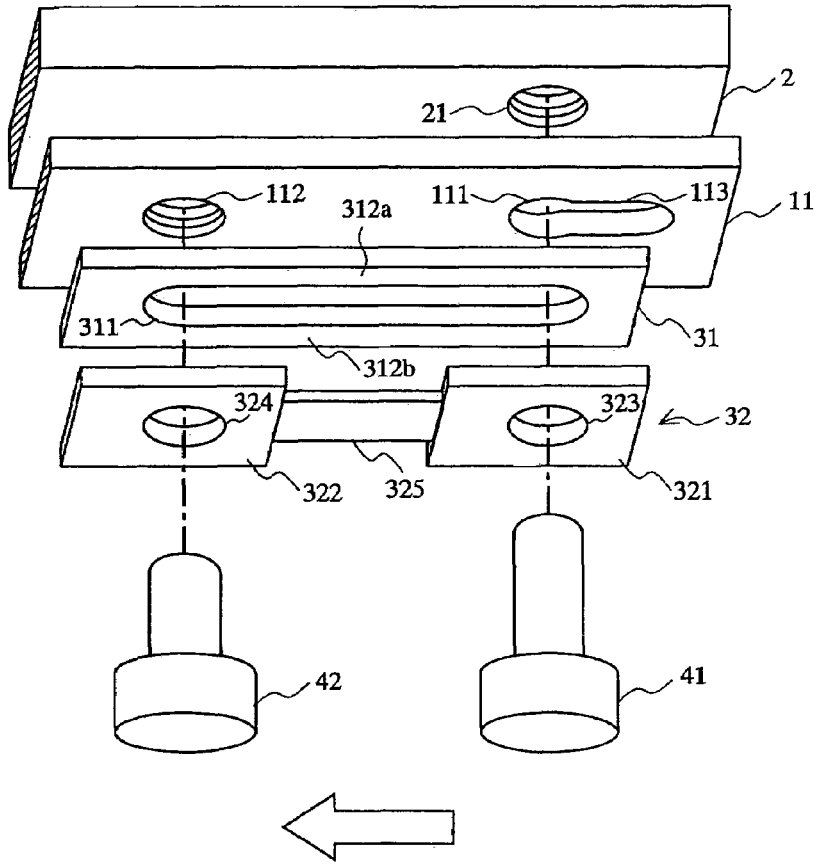
FIG. 2(*a*) is a perspective view and FIG. 2(*b*) a front view showing a construction of a connecting portion indicated as portion A in FIG. 1.
Figure 2:
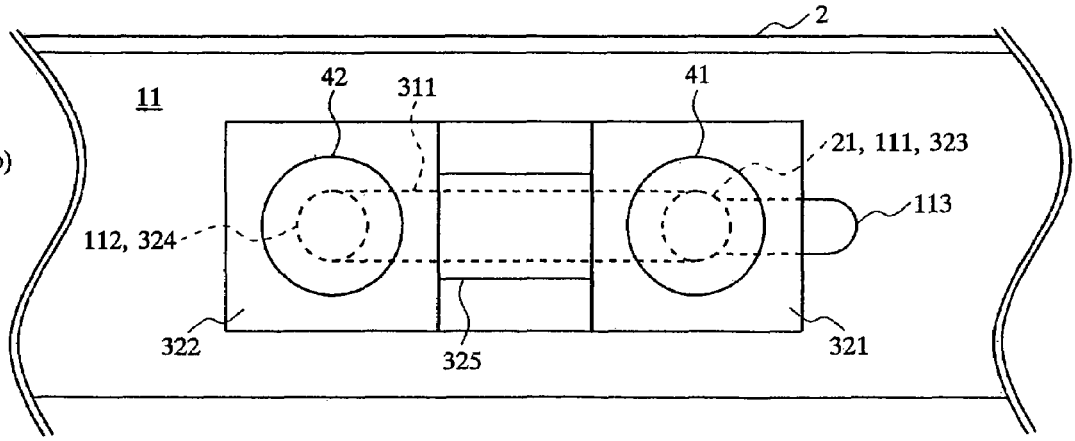

FIG. 2 is a perspective view and front view showing a construction of a connecting portion indicated as portion A in FIG. 1.

The molecular pump in accordance with the first embodiment has the connecting portions indicated as portion A in FIG. 1 provided at a plurality of places.

The molecular pump 1 is connected to the vacuum vessel 2 by fastening the flange 11 to the vacuum vessel 2 with bolts 41 each having a head at the terminal end thereof. The bolt 41 is fastening means for fastening the casing 3 to the vacuum vessel 2.

The vacuum vessel 2 is provided with bolt holes 21 for threadedly fixing the bolts 41. At the inner periphery of the bolt hole 21, a thread groove is provided to fix the bolt 41. By fixing the bolts 41 in the bolt holes 21, the flange 11 is connected to the vacuum vessel 2.

Between the bearing surface of the bolt 41 and the flange 11, a first buffering member 31 and a second buffering member 32 are interposed.

The first buffering member 31 and the second buffering member 32 are lapped on each other so that the first buffering member 31 is located on the flange 11 side.

One end of each of the first buffering member 31 and the second buffering member 32 is fixed to the vacuum vessel 2 with the bolt 41, and the other end thereof is fixed to the flange 11 with a bolt 42 having a head at the terminal end thereof.

The bolt 42 forms fixing means for fixing the first buffering member 31 and the second buffering member 32 to the flange 11 in the connecting portion.

The first buffering member 31 is provided, in the central portion thereof, with an elongated hole 311 of an elongated shape extending in the lengthwise direction.

The elongated hole 311 is formed so that the bolt 42 penetrates an end portion on the side of rotation direction of the rotor section and the bolt 41 penetrates an end portion on the opposite side. That is, both end portions in the lengthwise direction of the elongated hole 311 function as bolt holes for inserting the bolts 41 and 42.

Both end portions of the first buffering member 31 including both of the end portions in the lengthwise direction of the elongated hole 311 function as fixing portions for fixing the first buffering member 31 with the bolts 41 and 42. The fixing portion on the side of the bolt 41 is called a first fixing portion, and the fixing portion on the side of the bolt 42 is called a second fixing portion.

Therefore, the length in the lengthwise direction of the elongated hole 311 is determined based on an interval at which the bolt 41 and the bolt 42 are arranged. For example, the length is determined by adding the radiuses of bolts 41 and 42 to the interval at which the bolt 41 and the bolt 42 are arranged, and further by adding a clearance formed at the time of bolt penetration.

The elongated hole 311 is formed by a through hole provided with no thread groove.

The first buffering member 31 generates a tensile stress in buffering portions 312*a* and 312*b* which are formed on both sides of the elongated hole 311 and extend in the lengthwise direction.

In accordance with a necessary tensile stress, the material of the first buffering member 31 and the cross-sectional areas of the buffering portions 312*a* and 312*b* are determined.

The second buffering member 32 is made up of a washer portion 321 and a washer portion 322 provided at both ends and a buffering portion 325 provided between the washer portions 321 and 322.

The washer portion 321 functions as a first fixing portion for fixing the second buffering member 32 with the bolt 41, and the washer portion 322 functions as a second fixing portion for fixing the second buffering member 32 with the bolt 42. The washer portion 321 is in contact with the head of the bolt 41 over the whole circumference thereof, and the washer portion 322 is in contact with the head of the bolt 42 over the whole circumference thereof.

The washer portion 321 and the washer portion 322 are provided with a bolt hole 323 and a bolt hole 324 for inserting the bolt 41 and the bolt 42, respectively.

Each of the bolt holes 323 and 324 is a circular hole, and the diameter thereof is determined by adding a clearance at the time of bolt penetration to the diameter of the bolt 41 or the bolt 42.

Each of the bolt holes 323 and 324 is formed by a through hole provided with no thread groove.

The buffering portion 325 is a buffering mechanism for buffering a shock by generating a tensile stress, and is formed of a member having a distortion stress at least lower than that of the washer portions 321 and 322.

Therefore, when an excessive shock is generated, the buffering portion 325 reaches a deformation limit at an earlier stage than the washer portions 321 and 322.

All of the washer portions 321 and 322 and the buffering portion 325 can be formed of the same member. In this case, adjustment is made by changing the thickness, width, etc. of the buffering portion 325 so that a proper stress characteristic can be obtained.

Here, the stress characteristic that the first buffering member 31 and the second buffering member 32 have is explained.

Figure 3:
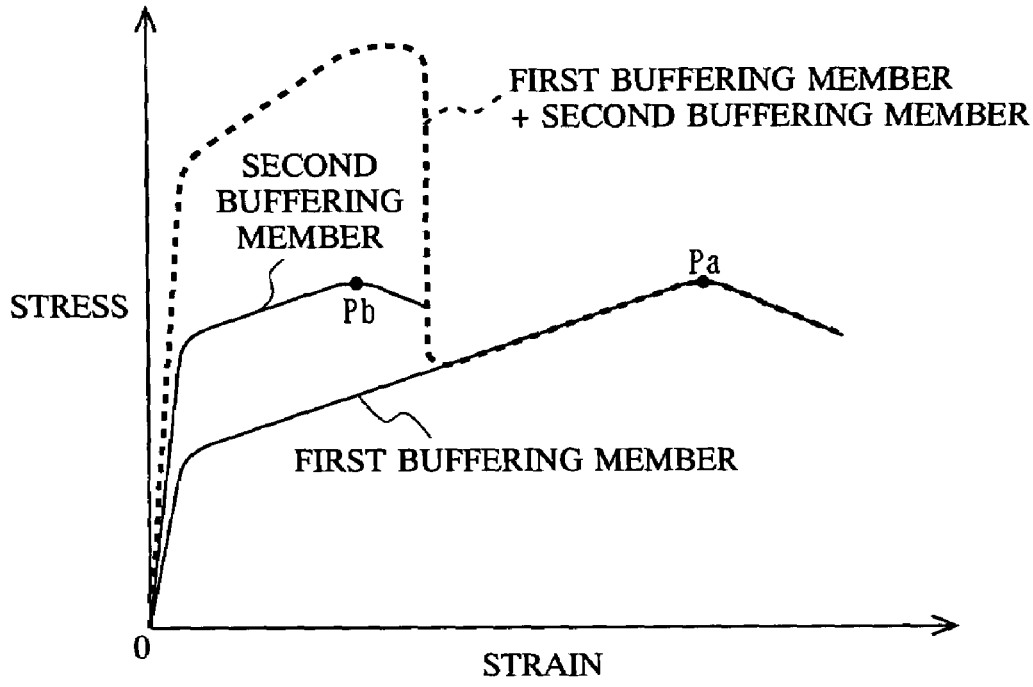
FIG. 3 is a graph showing a stress-strain characteristic of a first buffering member, a second buffering member, and a composite of the first and second buffering members.

FIG. 3 is a graph showing a stress-strain characteristic of the first buffering member 31, the second buffering member 32, and a composite of the first and second buffering members 31 and 32.

As shown in FIG. 3, the first buffering member 31 and the second buffering member 32 are each formed of a member having a different stress-strain characteristic.

The stress shown in the graph of FIG. 3 means a force resisting to an external force generated in a member subjected to torque due to external force, i.e., a shock. In the first embodiment, since a tensile action takes place on the first buffering member 31 and the second buffering member 32, this stress is a tensile stress.

For the first buffering member 31, the stress at the early stage of strain is lower than that of the second buffering member 32, but the strain before the stress reaches the maximum value Pa is larger than the strain of the second buffering member 32 before the stress reaches the maximum value Pb.

By combining members having a different stress characteristic and by utilizing the superiority of these members, a stress-stain characteristic (broken line) of a composite of the first and second buffering members 31 and 32 can be obtained.

As seen from the stress-stain characteristic of the composite, a high stress can be generated at the early stage of strain. Even after the stress has reached the maximum value Pb and the second buffering member has been broken, a stress can be generated by the first buffering member.

Thus, a high stress can be generated over a wide range of strain. Therefore, at a limited strain, energy given by a large external force, that is, energy due to a shock can be consumed.

The stress characteristic differs depending on the material and shape of buffering member. In order to obtain a proper stress characteristic, the first buffering member 31 and the second buffering member 32 may be formed of a member made of a resin such as a reinforced plastic, not of a metal such as aluminum, iron, or copper.

As shown in FIG. 2, the flange 11 is formed with a bolt hole 111 for inserting the bolt 41. This bolt hole 111 is a fastening hole for the bolt 41, which is fastening means for fastening the casing 3 to the vacuum vessel 2, to be inserted through.

Further, an elongated hole 113 is formed so as to extend from the bolt hole 111 in the direction opposite to the rotation direction of the rotor.

The elongated hole 113 formed in the flange 11 may be configured by an elongated hole extending in both directions from the bolt hole 111, provided that the elongated hole is at least a hole including the elongated hole 113 extending from the bolt hole 111 in the direction opposite to the rotation direction of the rotor.

Also, the flange 11 is formed with a bolt hole 112 for threadedly fixing the bolt 42. The bolt hole 112 is provided on the rotor rotation direction side of the bolt hole 111.

At the inner periphery of the bolt hole 21, a thread groove is provided to fix the bolt 41.

All of the bolt hole 111, the end portion on the side opposite to the rotor rotation direction of the elongated hole 311, and the bolt hole 323 are provided concentrically with the bolt hole 21.

Also, the end portion on the rotor rotation direction side of the elongated hole 311 and the bolt hole 324 are provided concentrically with the bolt hole 112.

In the first embodiment, the first buffering member 31 and the second buffering member 32 are arranged so as to be held between the bearing surface of the bolt 41 and the flange 11. The first buffering member 31 and the second buffering member 32 may be arranged between the vacuum vessel 2 and the flange 11. In this case, a construction is used in which gastightness can be secured in a connecting portion between the vacuum vessel 2 and the casing 3.

In the first embodiment, the first buffering member 31 and the second buffering member 32 are fixed to the flange 11 with the bolt 42. However, as means for fixing the first buffering member 31 and the second buffering member 32 to the flange 11, for example, staking or welding may be performed.

In the first embodiment, the flange 11 is fixed to the vacuum vessel 2 by threadedly fixing the bolt 41 in the bolt hole 21. However, for example, in the case where a flange portion like the flange 11 is provided at the outlet of the vacuum vessel 2, a through hole is formed in this flange portion of the vacuum vessel 2, and the casing 3 may be fixed to the flange portion of the vacuum vessel 2 by using a bolt and a nut via this through hole and the bolt hole 111.

In this case, the bolt and the nut function as fastening means for fastening the casing 3 to the vacuum vessel 2.

Also, the casing 3 may be fastened to the vacuum vessel 2 by using nuts installed from both directions without the use of the bolt having a head. In this case, the nut in contact with the second buffering member serves as the head in contact with the buffering member.

Next, the buffering function in the connecting portion thus constructed is explained.

If during the operation of the molecular pump 1, that is, at the time of high-speed rotation of the rotor section, extreme disturbance or a trouble such as deformation of rotor section or stator section or other malfunction occurs, and thus the rotor section comes into contact with a fixed member such as the stator section, a shock is generated due to torque that tends to rotate the whole of the molecular pump 1 in the rotation direction of the rotor section.

The shock due to this torque also gives a high stress to the vacuum vessel 2 connected to the molecular pump 1.

Figure 4:
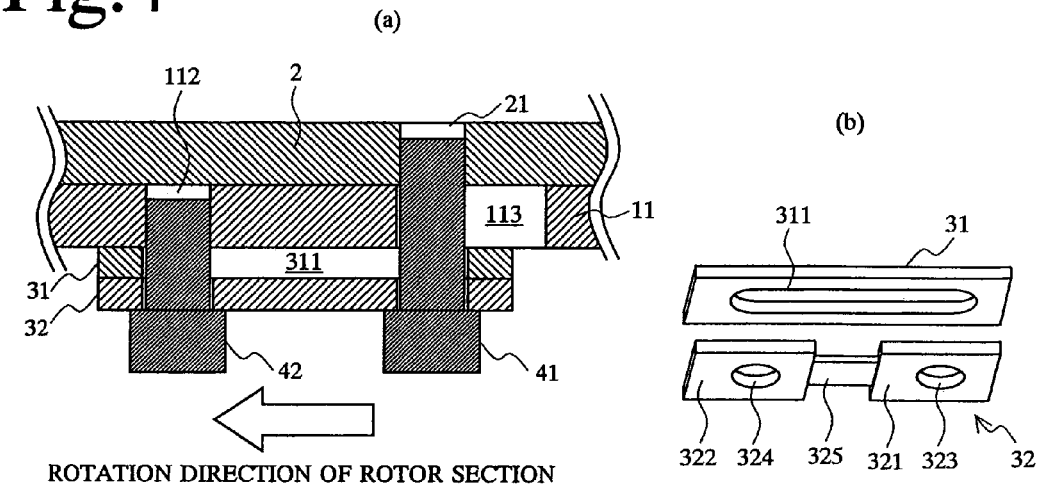
FIG. 4(*a*) is a sectional view taken along the line X-X' of a connecting portion indicated as portion A in FIG. 1 and FIG. 4(*b*) is a perspective view of the first and second buffering members, showing a state before a shock is generated at emergency time.

FIG. 4 is a sectional view taken along the line X-X' of a connecting portion indicated as portion A in FIG. 1, showing a state before a shock is generated at emergency time.

Figure 5:
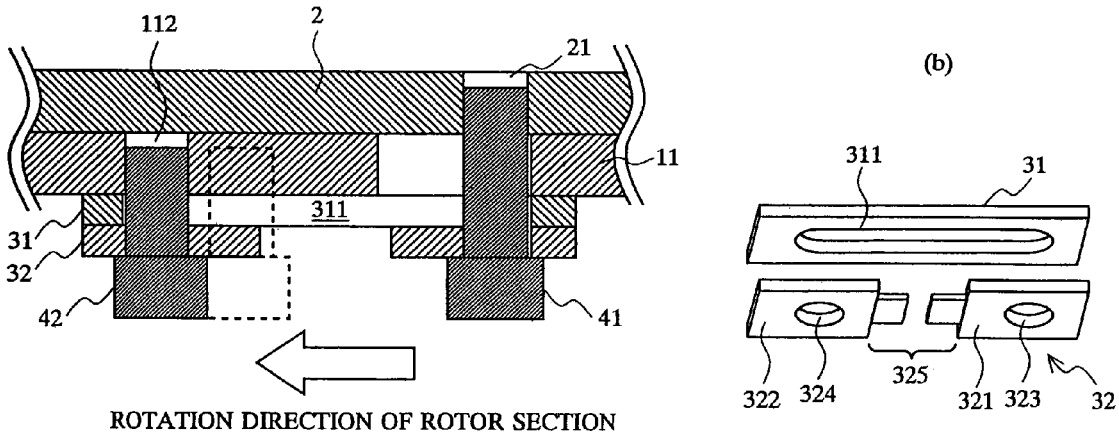
FIG. 5(*a*) is a sectional view taken along the line X-X' of a connecting portion indicated as portion A in FIG. 1 and FIG. 5(*b*) is a perspective view of the first and second buffering members, showing a state after a shock has been generated at emergency time.

Also, FIG. 5 is a sectional view taken along the line X-X' of a connecting portion indicated as portion A in FIG. 1, showing a state after a shock has been generated at emergency time.

If a shock is generated due to abnormal torque that tends to rotate the whole of the molecular pump 1 in the rotation direction of the rotor section, the flange 11 slips and rotates in the rotation direction of the rotor section with respect to the vacuum vessel 2 due to this shock.

At this time, since the position of the bolt 41 is fixed by the bolt hole 21 of the vacuum vessel 2, the flange 11 moves in the rotation direction of the rotor section along the elongated hole 113.

That is, the vacuum vessel 2 moves relatively in the opposite direction with respect to the flange 11. Therefore, the elongated hole 113 is formed so as to extend from the bolt hole 111 in the direction such that the vacuum vessel 2 moves relatively with respect to the flange 11.

The bolt 42 fixed to the flange 11 moves in the rotation direction of the rotor section.

At this time, the bolt 42 moves in the rotation direction of the rotor section while applying a force to the end portion on the rotor rotation direction side of the elongated hole 311 and the bolt hole 324. Also, a force equivalent to the force applied by the bolt 42 is applied to the end portion on the side opposite to the rotation direction of the rotor section of the elongated hole 311 and the bolt hole 323 in the direction opposite to the rotation of the rotor section by the bolt 41.

The buffering portions that are formed at both sides of the elongated hole 311 and extend in the lengthwise direction and the buffering portion 325 are pulled by the force applied by the bolt 41 and the bolt 42, so that a tensile stress acts (is generated). If the tensile stress acts, the first buffering member 31 and the second buffering member 32 are plastically deformed.

Specifically, for the first buffering member 31, since the buffering portions that are formed on both sides of the elongated hole 311 and extend in the lengthwise direction transform and elongate, the length in the lengthwise direction of the elongated hole 311 increases, and accordingly the thickness decreases.

For the second buffering member 32, the stress in the buffering portion 325 reaches the maximum value Pb, and hence the buffering portion 325 transforms and breaks at a position near the center thereof.

In the process in which the first buffering member 31 and the second buffering member 32 are transformed and plastically deformed, the energy that rotates the molecular pump 1 is consumed or absorbed by the first buffering member 31 and the second buffering member 32, whereby a shock is eased.

Figure 6:
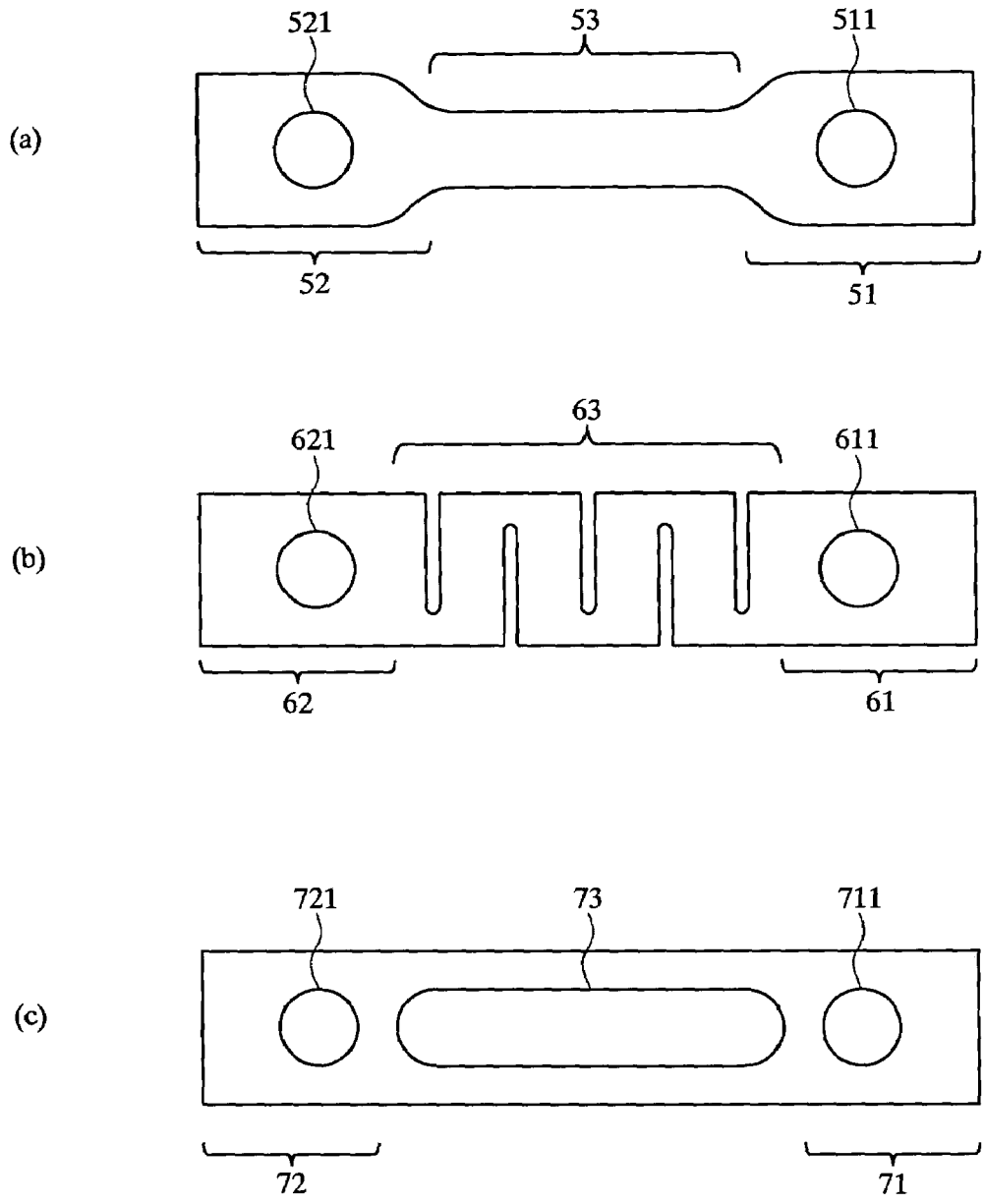
FIG. 6(*a*)-6(*c*) are views showing modifications of shape of a first buffering member and a second buffering member.

FIGS. 6(*a*) to 6(*c*) are views showing modifications of shape of the first buffering member 31 and the second buffering member 32.

The first buffering member 31 and the second buffering member 32 can be formed of a member having the shape shown in FIGS. 6(*a*) to 6(*c*).

The buffering member shown in FIG. 6(*a*) is formed by washer portions 51 and 52 provided at both ends and a buffering portion 53 provided between the washer portions 51 and 52.

The washer portions 51 and 52 function as fixing portions for fixing the buffering member with the bolts 41 and 42, respectively. Also, the washer portions 51 and 52 are in contact with the heads of the bolts over the whole circumference thereof.

The washer portions 51 and 52 are each provided with a bolt hole 511 and a bolt hole 521 for inserting the bolts 41 and 42, respectively.

Each of the bolt holes 511 and 521 is a circular hole, and the diameter thereof is determined by adding a clearance at the time of bolt penetration to the diameter of the bolt 41 or the bolt 42.

Each of the bolt holes 511 and 521 is formed by a through hole provided with no thread groove.

The buffering portion 53 is a buffering mechanism for buffering a shock by generating a tensile stress, and is formed into a shape having a distortion stress at least lower than that of the washer portions 51 and 52.

The buffering portion 53 has a construction such that shock energy is absorbed easily. Specifically, the buffering portion 53 is formed in a band shape such that the width thereof is narrower than that of the washer portions 51 and 52.

That is, the buffering member shown in FIG. 6(*a*) has, at both ends thereof, the washer portions each formed with a bolt hole, and the band-shaped buffering portion the width of which is narrower than that of the washer portions is formed between the washer portions.

The stress characteristic of the buffering portion 53 can be adjusted to a proper value by changing the length, width, and thickness thereof.

The buffering member shown in FIG. 6(*b*) is formed by washer portions 61 and 62 provided at both ends and a buffering portion 63 provided between the washer portions 61 and 62.

The washer portions 61 and 62 function as fixing portions for fixing the buffering member with the bolts 41 and 42, respectively. Also, the washer portions 61 and 62 are in contact with the heads of the bolts over the whole circumference thereof.

The washer portions 61 and 62 are each provided with a bolt hole 611 and a bolt hole 621 for inserting the bolts 41 and 42, respectively.

Each of the bolt holes 611 and 621 is a circular hole, and the diameter thereof is determined by adding a clearance at the time of bolt penetration to the diameter of the bolt 41 or the bolt 42.

Each of the bolt holes 611 and 621 is formed by a through hole provided with no thread groove.

The buffering portion 63 is a buffering mechanism for buffering a shock by generating a tensile stress, and is provided with slits formed alternately from one side in the lengthwise direction to the opposite side.

That is, the buffering member shown in FIG. 6(*b*) has, at both ends thereof, the washer portions each formed with a bolt hole, and the buffering portion having slits formed alternately from one side in the lengthwise direction to the opposite side is formed between the washer portions.

The stress characteristic of the buffering portion 63 can be adjusted to a proper value by changing the thickness of member, the slit length, and the number of slits.

The buffering member shown in FIG. 6(*c*) has washer portions 71 and 72 provided at both ends and an elongated hole 73 provided between the washer portions 71 and 72.

The washer portions 71 and 72 function as fixing portions for fixing the buffering member with the bolts 41 and 42, respectively. Also, the washer portions 71 and 72 are in contact with the heads of the bolts over the whole circumference thereof.

The washer portions 71 and 72 are each provided with a bolt hole 711 and a bolt hole 721 for inserting the bolts 41 and 42, respectively.

Each of the bolt holes 711 and 721 is a circular hole, and the diameter thereof is determined by adding a clearance at the time of bolt penetration to the diameter of the bolt 41 or the bolt 42.

Each of the bolt holes 711 and 721 is formed by a through hole provided with no thread groove.

The buffering member shown in FIG. 6(*c*) buffers a shock by generating a tensile stress in buffering portions that are formed at both sides of the elongated hole 73 and extend in the lengthwise direction, like the first buffering member 31.

That is, the buffering member shown in FIG. 6(*c*) has, at both ends thereof, the washer portions each formed with a bolt hole, and the elongated hole extending in the lengthwise direction is formed between the washer portions.

The stress characteristic of the buffering portions that are formed at both sides of the elongated hole 73 and extend in the lengthwise direction can be adjusted to a proper value by changing the length or width of the elongated hole 73.

The above-described first buffering member 31, the second buffering member 32, and modifications shown in FIGS. 6(*a*) to 6(*c*) may be used singly as a buffering member for buffering a shock generated at emergency time.

However, for the buffering member having a construction such that the bolts are installed penetratingly at both ends of the elongated hole like the first buffering member 31, since the bearing surface of bolt laps on the elongated hole, the bolt head is easily tilted in the direction toward the center or elongated hole when the flange 11 is moved by a shock.

Therefore, when the buffering member having no washer portions for stabilizing the bearing surfaces of the bolts 41 and 42, like the first buffering member 31, is used singly, it is preferable that washers dedicated to the bolts 41 and 42 be individually provided separately from the buffering member.

When a plurality of buffering members like the first buffering member 31 are used in a lapped manner, too, it is preferable that washers dedicated to the bolts 41 and 42 be individually provided separately from the buffering member.

Also, a plurality of buffering members may be selected from the first buffering member 31, the second buffering member 32, and the modifications shown in FIGS. 6(*a*) to 6(*c*) and combinedly used, or a plurality of same buffering members may be used.

In such a case, it is preferable that the buffering member provided with the washer portions for stabilizing the bearing surfaces of the bolts 41 and 42 be arranged on the outside, i.e., at a position at which the buffering member is in contact with the bolt heads.

The molecular pump 1 in accordance with the first embodiment is configured so that the strength of the bolt 41 is at least higher than the strength of the bolt 42.

Thereby, breakage of the bolt 41 occurring earlier than the breakage of the bolt 42 when the bolt is subjected to a shock can be restrained. Therefore, shock energy can be absorbed sufficiently before all of the installed bolts 41 are broken.

Also, when the bolt 42 is broken, i.e., is deformed, shock energy can be absorbed in the process of deformation of the bolt 42.

In the first embodiment, the bolt hole 112 is provided on the rotor rotation direction (arrow-marked direction) side of the bolt hole 111, by which shock energy generated at emergency time is consumed by a tensile stress acting on the first buffering member 31 and the second buffering member 32.

The configuration may be such that the bolt hole 112 is provided on the side opposite to the rotor rotation direction of the bolt hole 111, by which shock energy generated at emergency time is consumed by a compressive stress acting on the first buffering member 31 and the second buffering member 32.

In this case as well, the first buffering member 31 and the second buffering member 32 are formed by a plurality of members having a different stress compression characteristic so that a high stress can be generated over a wide range of strain due to compression.

By causing the compressive stress to act on the first buffering member 31 and the second buffering member 32, the energy that rotates the molecular pump 1 is consumed and a shock is eased in the process in which these members are plastically deformed.

According to the first embodiment, a shock of breaking torque can be consumed effectively by the use of a simple and inexpensive structure such as the first buffering member 31 and the second buffering member 32 regardless of the internal construction of the molecular pump 1.

Also, according to the first embodiment, if a tensile stress or a compressive stress can be caused to act sufficiently in the range of rotational movement distance (stroke) of the molecular pump 1, which depends on the lengthwise distance of the elongated hole 113 provided in the flange 11, the first buffering member 31 and the second buffering member 32 can be formed of a plastic member.

2. Second Embodiment

Next, a second embodiment of the present invention will be described. In this embodiment, the same reference numerals are applied to the same elements as those in the first embodiment, and the detailed explanation of the same elements is omitted.

Figure 7:
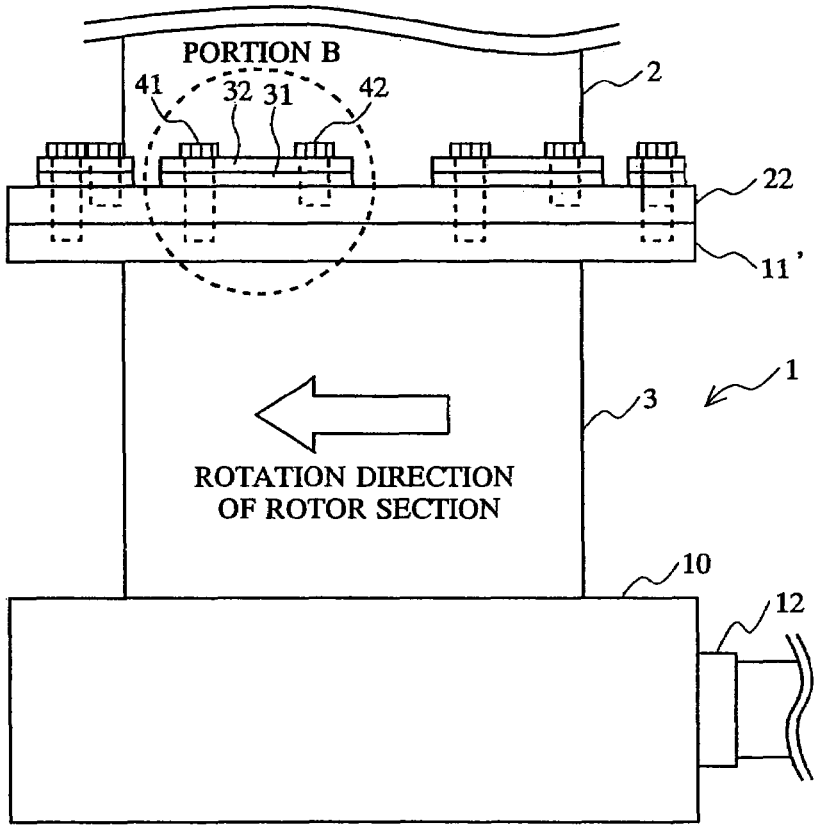
FIGS. 7(*a*)-7(*b*) are views showing one example of a connection mode of a molecular pump to a vacuum vessel in accordance with a second embodiment.
Figure 7:
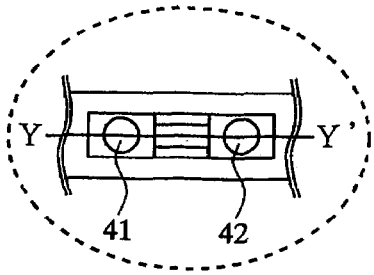

FIG. 7 is a view showing one example of a connection mode of a molecular pump 1 to a vacuum vessel 2 in accordance with the second embodiment.

The molecular pump 1 is the same vacuum pump as the molecular pump 1 explained in the first embodiment.

At the end of an inlet of a casing 3, a flange 11' is formed so as to protrude to the outer periphery side from the casing 3. The flange 11' is used as a connecting device for connecting the molecular pump 1 to the vacuum vessel 2.

The vacuum vessel 2 forms a vacuum device such as semiconductor manufacturing equipment or a lens barrel for electron microscope, and is provided with an outlet. At the end of this outlet, a flange 22 is formed so as to protrude to the outer periphery side from the outlet like the molecular pump 1. The flange 22 is used as a connecting device when the molecular pump 1 is connected to the vacuum vessel 2.

The molecular pump 1 is connected to the outlet of the vacuum pump 2 via the flanges 11' and 22 by using fastening means such as bolts.

Figure 8:
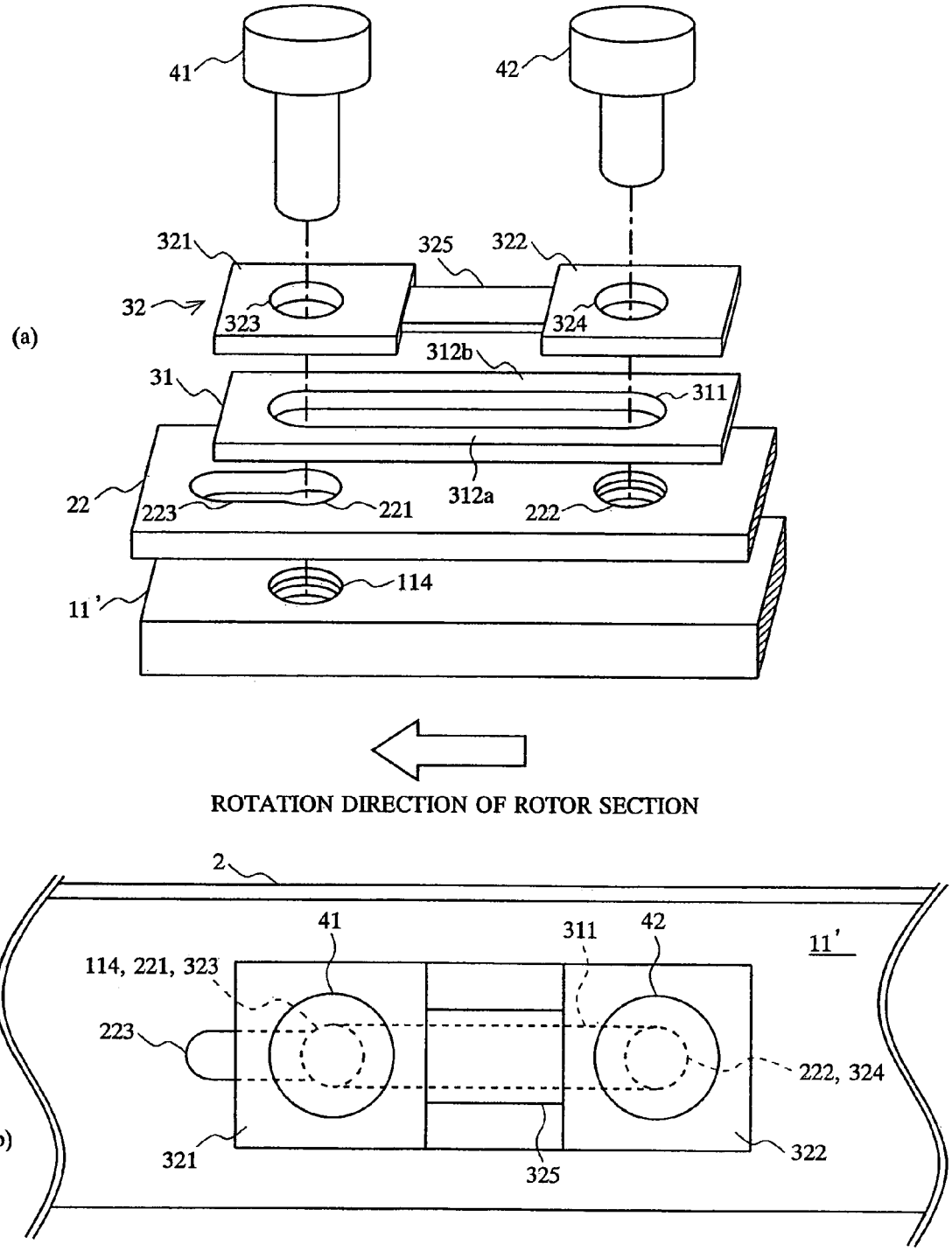
FIG. 8(*a*) is a perspective view and FIG. 8(*b*) a front view showing a construction of a connecting portion indicated as portion B in FIG. 7.

FIG. 8 is a perspective view and front view showing a construction of a connecting portion indicated as portion B in FIG. 7.

The molecular pump in accordance with the second embodiment has the connecting portions indicated as portion B in FIG. 1 provided at a plurality of places.

The molecular pump 1 is connected to the vacuum vessel 2 by fastening the flange 22 to the flange 11' with bolts 41 each having a head at the terminal end thereof. The bolt 41 is fastening means for fastening the casing 3 to the vacuum vessel 2.

The flange 11' is provided with a bolt hole 114 for threadedly fixing the bolt 41. At the inner periphery of the bolt hole 114, a thread groove is provided to fix the bolt 41. By fixing the bolts 41 in the bolt holes 114, the flange 22 is connected to the casing 3 of the molecular pump 1.

Between the bearing surface of the bolt 41 and the flange 22, a first buffering member 31 and a second buffering member 32 are interposed.

The first buffering member 31 and the second buffering member 32 are lapped on each other so that the second buffering member 32 is located on the bearing surface side of the bolt 41 and the first buffering member 31 is located on the flange 22 side.

One end of each of the first buffering member 31 and the second buffering member 32 is fixed to the flange 11' of the molecular pump 1 with the bolt 41, and the other end thereof is fixed to the flange 22 of the vacuum vessel 2 with a bolt 42 having a head at the terminal end thereof.

The bolt 42 forms fixing means for fixing the first buffering member 31 and the second buffering member 32 to the flange 22 in the connecting portion.

Since the first buffering member 31 and the second buffering member 32 have the same configuration as that of the members explained in the first embodiment, detailed explanation thereof is omitted.

The flange 22 is formed with a bolt hole 221 for inserting the bolt 41. This bolt hole 221 is a fastening hole for the bolt 41, which is fastening means for fastening the casing 3 to the vacuum vessel 2, to be inserted through.

Further, an elongated hole 223 is formed so as to extend from the bolt hole 221 in the rotation direction of the rotor.

The elongated hole formed in the flange 22 may be configured by an elongated hole extending in both directions from the bolt hole 221, provided that the elongated hole is at least a hole including the elongated hole 223 extending from the bolt hole 221 in the rotation direction of the rotor.

Also, the flange 22 is formed with a bolt hole 222 for threadedly fixing the bolt 42. The bolt hole 222 is provided on this side opposite to the rotor rotation direction of the bolt hole 221.

At the inner periphery of the bolt hole 114, a thread groove is provided to fix the bolt 41.

All of the bolt hole 221, the end portion on the rotor rotation direction side of an elongated hole 311, and a bolt hole 323 are provided concentrically with the bolt hole 114.

Also, the end portion on the opposite side of the rotor rotation direction of the elongated hole 311 and a bolt hole 324 are also provided concentrically with the bolt hole 222.

In the second embodiment, the first buffering member 31 and the second buffering member 32 are arranged so as to be held between the bearing surface of the bolt 41 and the flange 22. The first buffering member 31 and the second buffering member 32 may be arranged between the flange 22 and the flange 11'. In this case, a construction is used in which gastightness can be secured in a connecting portion between the vacuum vessel 2 and the casing 3.

In the second embodiment, the first buffering member 31 and the second buffering member 32 are fixed to the flange 22 with the bolt 42. However, as means for fixing the first buffering member 31 and the second buffering member 32 to the flange 22, for example, staking or welding may be performed.

In the second embodiment, the flange 22 is fixed to the vacuum vessel 2 by threadedly fixing the bolt 41 in the bolt hole 114. However, for example, a through hole is formed in the flange 11', and the casing 3 may be fixed to the vacuum vessel 2 by using a bolt and a nut via this through hole and the bolt hole 221.

In this case, the bolt and the nut function as fastening means for fastening the casing 3 to the vacuum vessel 2.

Also, the casing 3 may be fastened to the vacuum vessel 2 by using nuts installed from both directions without the use of the bolt having a head. In this case, the nut in contact with the second buffering member serves as the head in contact with the buffering member.

Next, the buffering function in the connecting portion thus constructed is explained.

Figure 9:
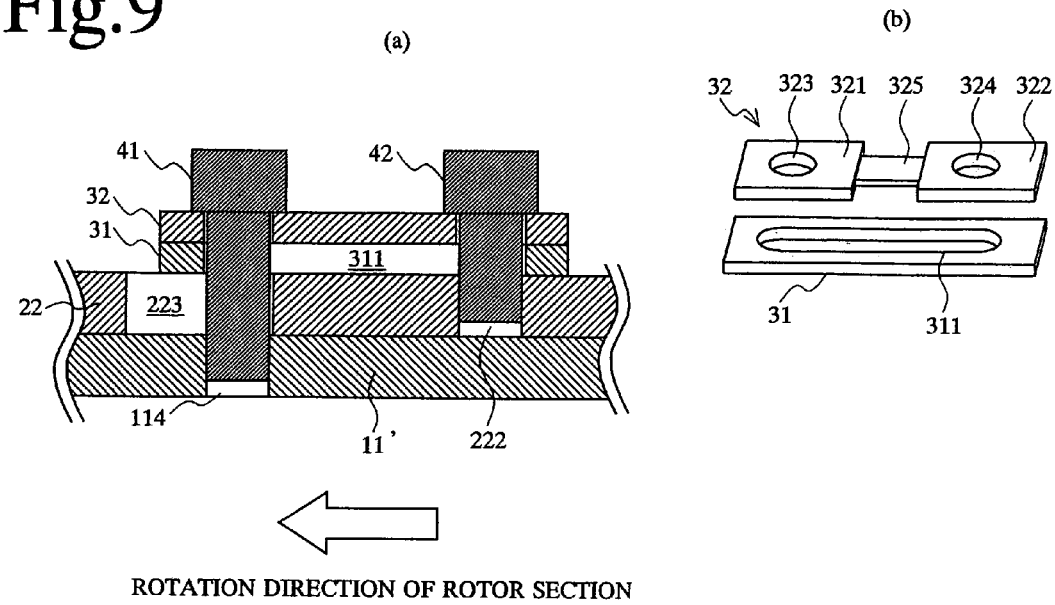
FIG. 9(*a*) is a sectional view taken along the line Y-Y' of a connecting portion indicated as portion B in FIG. 7 and FIG. 9(*b*) is a perspective view of the first and second buffering members, showing a state before a shock is generated at emergency time.

FIG. 9 is a sectional view taken along the line Y-Y' of a connecting portion indicated as portion B in FIG. 7, showing a state before a shock is generated at emergency time.

Figure 10:
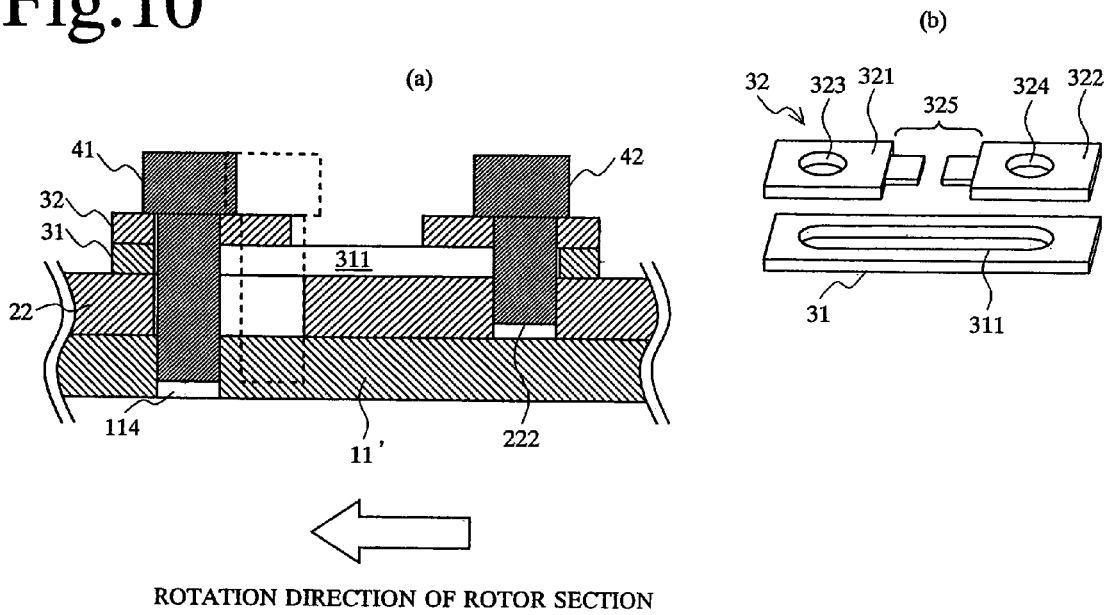
FIG. 10(*a*) is a sectional view taken along the line Y-Y' of a connecting portion indicated as portion B in FIG. 7 and FIG. 10(*b*) is a perspective view of the first and second buffering members, showing a state after a shock has been generated at emergency time.

Also, FIG. 10 is a sectional view taken along the line Y-Y' of a connecting portion indicated as portion B in FIG. 7, showing a state after a shock has been generated at emergency time.

If a shock is generated due to torque that tends to rotate the whole of the molecular pump 1 in the rotation direction of the rotor section, the flange 11' slips and rotates in the rotation direction of the rotor section with respect to the flange 22 due to this shock.

That is, the flange 22 moves relatively in the opposite direction with respect to the flange 11'. Therefore, the elongated hole 223 is formed so as to extend from the bolt hole 221 in the direction such that the flange 11' moves relatively with respect to the flange 22.

The bolt 41, which is fixed to the bolt hole 114 in the flange 11', moves in the rotation direction of the rotor section along the elongated hole 223 due to the movement of the flange 11'.

The flange 22 moves relatively on the direction opposite to the flange 11'. Therefore, as viewed relatively with respect to the flange 11', the bolt 42 moves while applying a force to the end portion on the side opposite to the rotor rotation direction of the elongated hole 311 and the bolt hole 324 in the direction opposite to the rotation direction of the rotor section. Also, a force equivalent to the force applied by the bolt 42 is applied to the end portion on the rotor rotation direction side of the elongated hole 311 and the bolt hole 323 in the rotation direction of the rotor section by the bolt 41.

The buffering portions that are formed at both sides of the elongated hole 311 transform and extend in the lengthwise direction and the buffering portion 325 are pulled by the force applied by the bolt 41 and the bolt 42, so that a tensile stress acts (is generated). If the tensile stress acts, the first buffering member 31 and the second buffering member 32 are plastically deformed.

In the process in which the first buffering member 31 and the second buffering member 32 are transformed and plastically deformed, the energy that rotates the molecular pump 1 is consumed and absorbed by the first buffering member 31 and the second buffering member 32, whereby a shock is eased.

Also, in the first buffering member 31 and the second buffering member 32 shown in the second embodiment as well, the modifications shown in FIGS. 6(*a*) to 6(*c*) in accordance with the first embodiment can be applied.

As in the first embodiment, modifications shown in FIGS. 6(*a*) to 6(*c*) may be used singly as a buffering member for buffering a shock generated at emergency time.

However, for the buffering member having a construction such that the bolts are installed penetratingly at both ends of the elongated hole like the first buffering member 31, since the bearing surface of bolt laps on the elongated hole, the bolt head is easily tilted in the direction toward the center or elongated hole when the flange 22 is moved relatively with respect to the flange 11' by a shock.

Therefore, when the buffering member having no washer portions for stabilizing the bearing surfaces of the bolts 41 and 42, like the first buffering member 31, is used singly, it is preferable that washers dedicated to the bolts 41 and 42 be individually provided separately from the buffering member.

When a plurality of buffering members like the first buffering member 31 are used in a lapped manner, too, it is preferable that washers dedicated to the bolts 41 and 42 be individually provided separately from the buffering member.

Also, a plurality of buffering members may be selected from the first buffering member 31, the second buffering member 32, and the modifications shown in FIGS. 6(*a*) to 6(*c*) and combinedly used, or a plurality of same buffering members may be used.

In such a case, it is preferable that the buffering member provided with the washer portions for stabilizing the bearing surfaces of the bolts 41 and 42 be arranged on the outside, i.e., at a position at which the buffering member is in contact with the bolt heads.

In the second embodiment as well, the configuration is such that the strength of the bolt 41 is at least higher than the strength of the bolt 42.

Thereby, breakage of the bolt 41 occurring earlier than the breakage of the bolt 42 when the bolt is subjected to a shock can be restrained. Therefore, shock energy can be absorbed sufficiently before all of the installed bolts 41 are broken.

Also, when the bolt 42 is broken, i.e., is deformed, shock energy can be absorbed in the process of deformation of the bolt 42.

In the second embodiment as well, the configuration may be such that the bolt hole 222 is provided on the rotor rotation direction side of the bolt hole 114, by which shock energy generated at emergency time is consumed by a compressive stress acting on the first buffering member 31 and the second buffering member 32.

In this case as well, the first buffering member 31 and the second buffering member 32 are formed by a plurality of members having a different stress compression characteristic so that a high stress can be generated over a wide range of strain due to compression.

By causing the compressive stress to act on the first buffering member 31 and the second buffering member 32, the energy that rotates the molecular pump 1 is consumed and a shock is eased in the process in which these members are plastically deformed.

According to the second embodiment, a shock of breaking torque can be consumed effectively by the use of a simple and inexpensive structure such as the first buffering member 31 and the second buffering member 32 regardless of the internal construction of the molecular pump 1.

Also, according to the second embodiment, if a tensile stress or a compressive stress can be caused to act sufficiently in the range of rotational movement distance (stroke) of the molecular pump 1, which depends on the lengthwise distance of the elongated hole 223 provided in the flange 22, the first buffering member 31 and the second buffering member 32 can be formed of a plastic member.

Also, in combination with the configuration of connecting portion between the vacuum vessel 2 and the casing 3 shown in the second embodiment, the configuration of connecting portion between the vacuum vessel 2 and the casing 3 shown in the first embodiment may be used.

In this case, the connecting portion of the first embodiment is configured so that the flange 22 shown in the second embodiment corresponds to the vacuum vessel 2 shown in the first embodiment.

Also, the bolt 41 may be formed by a fastening member for fastening the casing 3 to the vacuum vessel 2 by using nuts installed from both directions without the use of the bolt having a head so that the bolt 41 can be used for both of the connecting portion shown in the first embodiment and the connecting portion shown in the second embodiment.

As shown in the second embodiment, there can be provided a vacuum vessel capable of effectively consuming a shock of breaking torque by using a simple and inexpensive construction, the vacuum vessel being connected with a molecular pump for exhausting gas, which has a casing provided with an inlet and an outlet; a rotor which is pivotally supported in the casing and is provided with a gas transfer mechanism for transferring gas from the inlet to the outlet; and a motor for rotating the rotor, and being provided with a flange-shaped connecting portion which is formed in a joining portion with the molecular pump and is formed with a fastening hole penetrating in the thickness direction and an elongated hole extending from the fastening hole in the rotation direction of the rotor; a buffering member having a buffering portion, a first fixing portion which is provided at one end of the buffering portion and has a fastening hole, and a second fixing portion formed at the other end of the buffering portion; fastening means for fastening the buffering member to the casing via the fastening hole in the connecting portion and the fastening hole in the buffering member; and fixing means for fixing the second fixing portion of the buffering member to the connecting portion.

Figure 11:
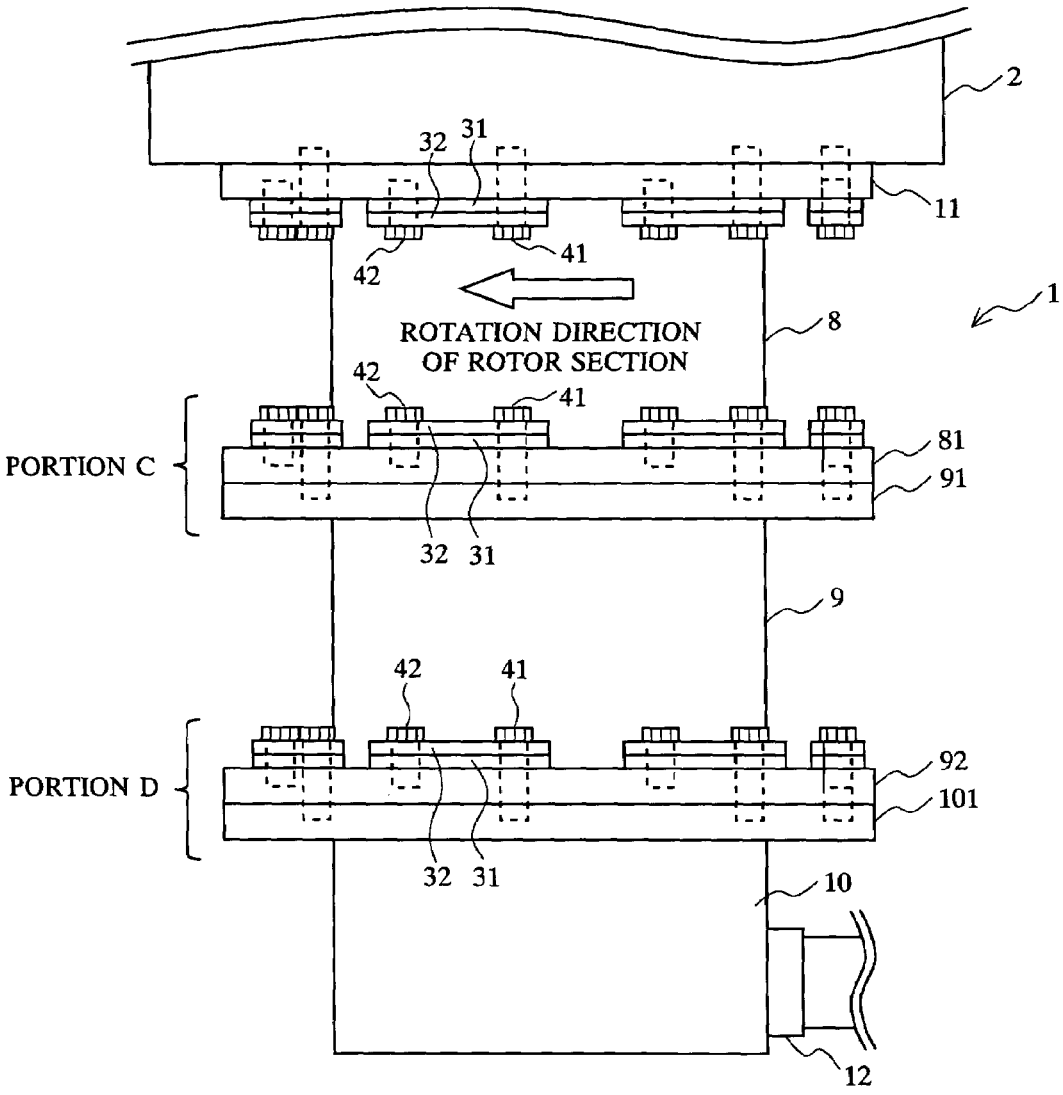
FIG. 11 is an explanatory view of a modification of a connecting device for connecting a molecular pump to a vacuum vessel shown in the first embodiment and the second embodiment.

FIG. 11 is an explanatory view of a modification of a connecting device for connecting the molecular pump 1 to the vacuum vessel 2 shown in the first embodiment and the second embodiment.

As shown in FIG. 11, the same configuration as that of the connecting methods shown in the first and second embodiments can also be used in a connecting portion (portion C) between a casing 8 and a casing 9, which are formed by dividing the casing 3 of the molecular pump 1 into two in the axial direction of the rotor, and a connecting portion (portion D) between the casing 9 or the casing 3 and the base 10 forming the housing of the molecular pump 1.

The connecting portion shown as portion C in FIG. 11 is explained.

The casing 8 is formed with a flange 81 protruding to the outer periphery side at the end on the base 10 side. Also, the casing 9 is formed with a flange 91 protruding to the outer periphery side at the end on the inlet side.

In the casings 8 and 9, there is provided a rotor section which is rotated at a high speed by the action of a motor.

That is, the casings 8 and 9 form a vessel incorporating a rotator.

Here, it is assumed that when a shock is generated at emergency time as described above, the casing 8 is subjected to a greater shock than the casing 9. This assumes a case where, for example, the inlet side of rotor section is formed by a turbo-molecular pump, and a thread groove pump is formed on the base 10 side.

When the configuration of connecting method shown in the first embodiment is applied, the casing 8 is regarded as the casing 3 shown in the first embodiment, and the casing 9 is regarded as the vacuum vessel 2 shown in the first embodiment. That is, the flange 81 corresponds to the flange 11 shown in the first embodiment, and the flange 91 corresponds to the vacuum vessel 2.

Therefore, the flange 81 and the flange 91 are made to correspond to the flange 11 and the vacuum pump 2 shown in the first embodiment, and in this state, the same configuration as that shown in the first embodiment is used.

Specifically, the flange 81 is provided with holes corresponding to the bolt hole 112, the bolt hole 111, and the elongated hole 113, and the flange 91 is provided with a hole corresponding to the bolt hole 21, each hole being formed at a position corresponding to the rotation direction of the rotor section. As in the first embodiment, the first buffering member 31, the second buffering member 32, the bolt 41, and the bolt 42 are arranged.

By configuring the connecting portion (portion C) between the casing 8 and the casing 9 in this manner, a shock of breaking torque can be consumed effectively by using a simple and inexpensive construction.

When the configuration of connecting method shown in the second embodiment is applied, the casing 8 is regarded as the casing 3 shown in the second embodiment, and the casing 9 is regarded as the vacuum vessel 2 shown in the second embodiment. That is, the flange 81 corresponds to the flange 11' shown in the second embodiment, and the flange 91 corresponds to the flange 22.

Therefore, the flange 81 and the flange 91 are made to correspond to the flange 11' and the flange 22 shown in the second embodiment, and in this state, the same configuration as that shown in the second embodiment is used.

Specifically, the flange 81 is provided with a hole corresponding to the bolt hole 114, and the flange 91 is provided with holes corresponding to the bolt hole 222, the bolt hole 221, and the elongated hole 223, each hole being formed at a position corresponding to the rotation direction of the rotor section. As in the second embodiment, the first buffering member 31, the second buffering member 32, the bolt 41, and the bolt 42 are arranged.

By configuring the connecting portion (portion C) between the casing 8 and the casing 9 in this manner, a shock of breaking torque can be consumed effectively by using a simple and inexpensive construction.

The connecting portion shown as portion D in FIG. 11 is explained.

The casing 9 is formed with a flange 92 protruding to the outer periphery side at the end on the base 10 side. Also, the base 10 is formed with a flange 101 protruding to the outer periphery side at the end on the inlet side.

In the casings 8 and 9, there is provided a rotor section which is rotated at a high speed by the action of a motor.

The casing 9 may be a divided casing, or may be a non-divided casing 3 as shown in FIG. 1.

When the configuration of connecting method shown in the first embodiment is applied, the casing 9 is regarded as the casing 3 shown in the first embodiment, and the base 10 is regarded as the vacuum vessel 2 shown in the first embodiment. That is, the flange 92 corresponds to the flange 11 shown in the first embodiment, and the flange 101 corresponds to the vacuum vessel 2.

Therefore, the flange 92 and the flange 101 are made to correspond to the flange 11 and the vacuum pump 2 shown in the first embodiment, and in this state, the same configuration as that shown in the first embodiment is used.

Specifically, the flange 92 is provided with holes corresponding to the bolt hole 112, the bolt hole 111, and the elongated hole 113, and the flange 101 is provided with a hole corresponding to the bolt hole 21, each hole being formed at a position corresponding to the rotation direction of the rotor section. As in the first embodiment, the first buffering member 31, the second buffering member 32, the bolt 41, and the bolt 42 are arranged.

The flange 92 may be connected directly to the base 10 without providing the flange 101 on the base 10.

By configuring the connecting portion (portion D) between the casing 9 and the base 10 in this manner, a shock of breaking torque can be consumed effectively by using a simple and inexpensive construction.

When the configuration of connecting method shown in the second embodiment is applied, the casing 9 is regarded as the casing 3 shown in the second embodiment, and the base 10 is regarded as the vacuum vessel 2 shown in the second embodiment. That is, the flange 92 corresponds to the flange 11' shown in the second embodiment, and the flange 101 corresponds to the flange 22.

Therefore, the flange 92 and the flange 101 are made to correspond to the flange 11' and the flange 22 shown in the second embodiment, and in this state, the same configuration as that shown in the second embodiment is used.

Specifically, the flange 92 is provided with a hole corresponding to the bolt hole 114, and the flange 101 is provided with holes corresponding to the bolt hole 222, the bolt hole 221, and the elongated hole 223, each hole being formed at a position corresponding to the rotation direction of the rotor section. As in the second embodiment, the first buffering member 31, the second buffering member 32, the bolt 41, and the bolt 42 are arranged.

By configuring the connecting portion (portion D) between the casing 9 and the base 10 in this manner, a shock of breaking torque can be consumed effectively by using a simple and inexpensive construction.

The connection configuration shown in the first or second embodiment can be used in the connecting portion between the vacuum vessel 2 and the casing 3, the connecting portion between the divided casings 8 and 9, and the connecting portion between the casing 3 or the casing 9 and the base 10.

The connection configuration shown in the first or second embodiment may be used singly in any of these connecting portions, or may be used in all of these connecting portions.

What is claimed is:

1. A molecular pump attached to a vacuum vessel for exhausting gas from the vacuum vessel, comprising:

a casing having a stator and provided with an inlet and an outlet;

a rotor rotatably supported in the casing and cooperating with the stator for transferring gas from the inlet to the outlet;

a motor for rotating the rotor;

a flange attachment portion connected to an end portion of the casing and having a fastening hole extending through the flange attachment portion in the thickness direction and an elongated hole extending from the fastening hole in a direction opposite to the rotation direction of the rotor;

a buffering member having a buffering portion that transforms and absorbs shock energy due to abnormal torque generated during malfunction of the molecular pump, a first fixing portion provided at one end of the buffering portion and having a fastening hole, and a second fixing portion provided at the other end of the buffering portion;

fastening means for fastening the buffering member to the vacuum vessel via the fastening hole in the flange attachment portion and the fastening hole in the buffering member; and fixing means for fixing the second fixing portion of the buffering member to the flange attachment portion but not to the vacuum vessel.

2. The molecular pump according to claim 1, wherein the buffering member is by comprised of a plurality of members having different stress-strain characteristics.

3. The molecular pump according to claim 1, wherein the fastening means has a higher strength than the fixing means.

4. The molecular pump according to claim 2, wherein the fastening means has a higher strength than the fixing means.

5. The molecular pump according to claim 1, wherein the fixing means is arranged on the side opposite to the side on which the elongated hole is formed with respect to the fastening means.

6. The molecular pump according to claim 2, wherein the fixing means is arranged on the side opposite to the side on which the elongated hole is formed with respect to the fastening means.

7. The molecular pump according to claim 3, wherein the fixing means is arranged on the side opposite to the side on which the elongated hole is formed with respect to the fastening means.

8. The molecular pump according to claim 4, wherein the fixing means is arranged on the side opposite to the side on which the elongated hole is formed with respect to the fastening means.

9. The molecular pump according to claim 1, wherein at least one of the fastening means and the fixing means comprises a bolt having a head at the terminal end thereof, and the fixing portion of the buffering member which is in contact with the head of the bolt contacts the bolt over the whole circumference of the head of the bolt.

10. The molecular pump according to claim 2, wherein at least one of the fastening means and the fixing means comprises a bolt having a head at the terminal end thereof, and the fixing portion of the buffering member which is in contact with the head of the bolt contacts the bolt over the whole circumference of the head of the bolt.

11. The molecular pump according to claim 3, wherein at least one of the fastening means and the fixing means comprises a bolt having a head at the terminal end thereof, and the fixing portion of the buffering member which is in contact with the head of the bolt contacts the bolt over the whole circumference of the head of the bolt.

12. The molecular pump according to claim 4, wherein at least one of the fastening means and the fixing means comprises a bolt having a head at the terminal end thereof, and the fixing portion of the buffering member which is in contact with the head of the bolt contacts the bolt over the whole circumference of the head of the bolt.

13. The molecular pump according to claim 5, wherein at least one of the fastening means and the fixing means comprises a bolt having a head at the terminal end thereof, and the fixing portion of the buffering member which is in contact with the head of the bolt contacts the bolt over the whole circumference of the head of the bolt.

14. The molecular pump according to claim 6, wherein at least one of the fastening means and the fixing means comprises a bolt having a head at the terminal end thereof, and the fixing portion of the buffering member which is in contact with the head of the bolt contacts the bolt over the whole circumference of the head of the bolt.

15. The molecular pump according to claim 7, wherein at least one of the fastening means and the fixing means comprises a bolt having a head at the terminal end thereof, and the fixing portion of the buffering member which is in contact with the head of the bolt contacts the bolt over the whole circumference of the head of the bolt.

16. The molecular pump according to claim 8, wherein at least one of the fastening means and the fixing means comprises a bolt having a head at the terminal end thereof, and the fixing portion of the buffering member which is in contact with the head of the bolt contacts the bolt over the whole circumference of the head of the bolt.

17. A connecting device for connecting a first vessel and a second vessel, at least one of which incorporates a rotator, to each other, comprising:

a flange connected to the first vessel and having a fastening hole extending therethrough in the thickness direction and an elongated hole extending from the fastening hole in the direction such that the second vessel moves relatively when being subjected to a shock due to abnormal torque in the rotation direction of the rotator during malfunction of the rotator;

a buffering member having a buffering portion that transforms and absorbs shock energy when the second vessel moves relatively, a first fixing portion provided at one end of the buffering portion and having a fastening hole, and a second fixing portion provided at the other end of the buffering portion;

fastening means for fastening the buffering member to the second vessel via the fastening hole in the flange and the fastening hole in the buffering member; and fixing means for fixing the second fixing portion of the buffering member to the flange but not to the second vessel.

18. The connecting device according to claim 17, wherein the buffering member is comprised of a plurality of members having different stress-strain characteristics.

19. The connecting device according to claim 17, wherein the fastening means has a higher strength than the fixing means.

20. The connecting device according to claim 18, wherein the fastening means has a higher strength than the fixing means.

* * * * *